US005229779A

United States Patent [19]

du Mesnildot

[11] Patent Number: 5,229,779

[45] Date of Patent: Jul. 20, 1993

[54] ANTI-ICER SYSTEM FOR RADAR ANTENNA

[75] Inventor: Francois du Mesnildot, Billancourt, France

[73] Assignee: Thomson-CSF, Puteaux, France

[21] Appl. No.: 842,633

[22] Filed: Feb. 27, 1992

[30] Foreign Application Priority Data

Mar. 8, 1991 [FR] France ..... 91 02825

[51] Int. Cl.[5] ..... H01Q 1/02

[52] U.S. Cl. ..... 343/704

[58] Field of Search ..... 343/704, 872

[56] References Cited

U.S. PATENT DOCUMENTS 3,146,449 8/1964 Serge et al. ..... 343/704

4,999,639 3/1991 Frazita et al. ..... 343/704

FOREIGN PATENT DOCUMENTS 339950 9/1959 Switzerland .

959004 5/1964 United Kingdom .

*Primary Examiner*—Rolf Hille

*Assistant Examiner*—Hoanganh Le

*Attorney, Agent, or Firm*—Oblon, Spivak, McClelland, Maier & Neustadt

[57] ABSTRACT

Disclosed is an anti-icer system that can be used to neutralize the effects of a nuclear electromagnetic pulse or of parasitic electromagnetic fields coming from other radars transmitting in the vicinity. This anti-icer comprises a sheet of conductive wires positioned on a screen placed before the aperture of the radar antenna and connected in series/parallel combinations to the terminals of a supply source so that each is crossed by a heating current. The conductive wires of the sheet and their interconnections form at least one pair of patterns, on the screen, that are symmetrical with reference to an axis. This symmetry provides for a neutralization by opposition of the induced electromotive forces. FIG. 2.

6 Claims, 2 Drawing Sheets

ANTI-ICER SYSTEM FOR RADAR ANTENNA

BACKGROUND OF THE INVENTION

1. Field of the Invention

The present invention relates to an anti-icer circuit that is designed for a radar antenna and can further be used to neutralize the effects of a nuclear electromagnetic pulse or of parasitic electromagnetic fields coming from other radars transmitting in the vicinity.

2. Description of the Prior Art

Electronic scanning radar antennas are generally fitted out with a screen provided with a vertical polarization grid formed by a fine network of horizontal rectilinear conductive wires. This network of horizontal conductive wires is profitably used to make a heating grid constituting an anti-icer system for the screen. Within this heating grid, the horizontal rectilinear conductive wires are connected to one another by their ends in a series/parallel combination enabling them to be connected to the terminals of a supply source, and enabling a heating current to be made to flow in each of them. Seen from the supply source which gives the heating current, the horizontal rectilinear conductors, with their interconnection wiring, form one or more identical patterns that cover the surface of the screen. These patterns constitute turns in which an electromagnetic pulse may induce an electromotive force that must be dissipated to the ground and must have its supply source protected. A known way of doing this lies, firstly, in positioning dischargers between the ground and each terminal of the supply source and, secondly, in interposing pulse current blocking filters, in series, with the terminals of the supply source.

These protection systems, which are efficient, have the drawback of being bulky, heavy and costly. Indeed, for a screen area of the order of 2 $m^2$ covered with two anti-icer half-circuits each consuming power of 750 Watts delivered under 140 volts DC, it is necessary to have dischargers and protection filters weighing about 25 kg occupying a volume of about 25 $dm^3$ which is far from being negligible, especially if it is considered that these protection elements as well as the screen are often designed to be mounted on a rotary antenna support that can be driven by a rotational motion of the order of one rotation per second.

An aim of the present invention is to reduce the volume, weight and cost of the dischargers and protection filters of a radar antenna anti-icer system in seeking to achieve the reduction, by neutralization, of the amplitude of the electromotive forces induced at the terminals of an anti-icer system by an electromagnetic pulse.

SUMMARY OF THE INVENTION

An object of the invention is an anti-icer system for a radar antenna constituted by a sheet of conductive wires positioned on a screen and connected in series/-parallel combinations to the terminals of a supply source so as to be crossed by a heating current. In this anti-icer system, the conductive wires and their interconnections form at least one pair of patterns, on the screen, that are symmetrical with reference to an axis.

Owing to their symmetry with respect to an axis, the two patterns of a pair constitute two turns having the same area at the terminals of the supply source, these two turns being crossed in opposite directions by the induced electromotive forces which neutralize each other. Through this neutralization, all that reaches the terminals of the supply source of the anti-icer system is a residual induced electromotive force that enables the use of protection devices, namely dischargers and filters, that have lower performance values and, consequently, occupy less space without thereby increasing the cost of making the anti-icer system.

BRIEF DESCRIPTION OF THE DRAWINGS

Other features and advantages of the invention shall appear from the following description of an embodiment. This description shall be made hereinafter with reference to the appended drawing in which.

MORE DETAILED DESCRIPTION

Figure 1:
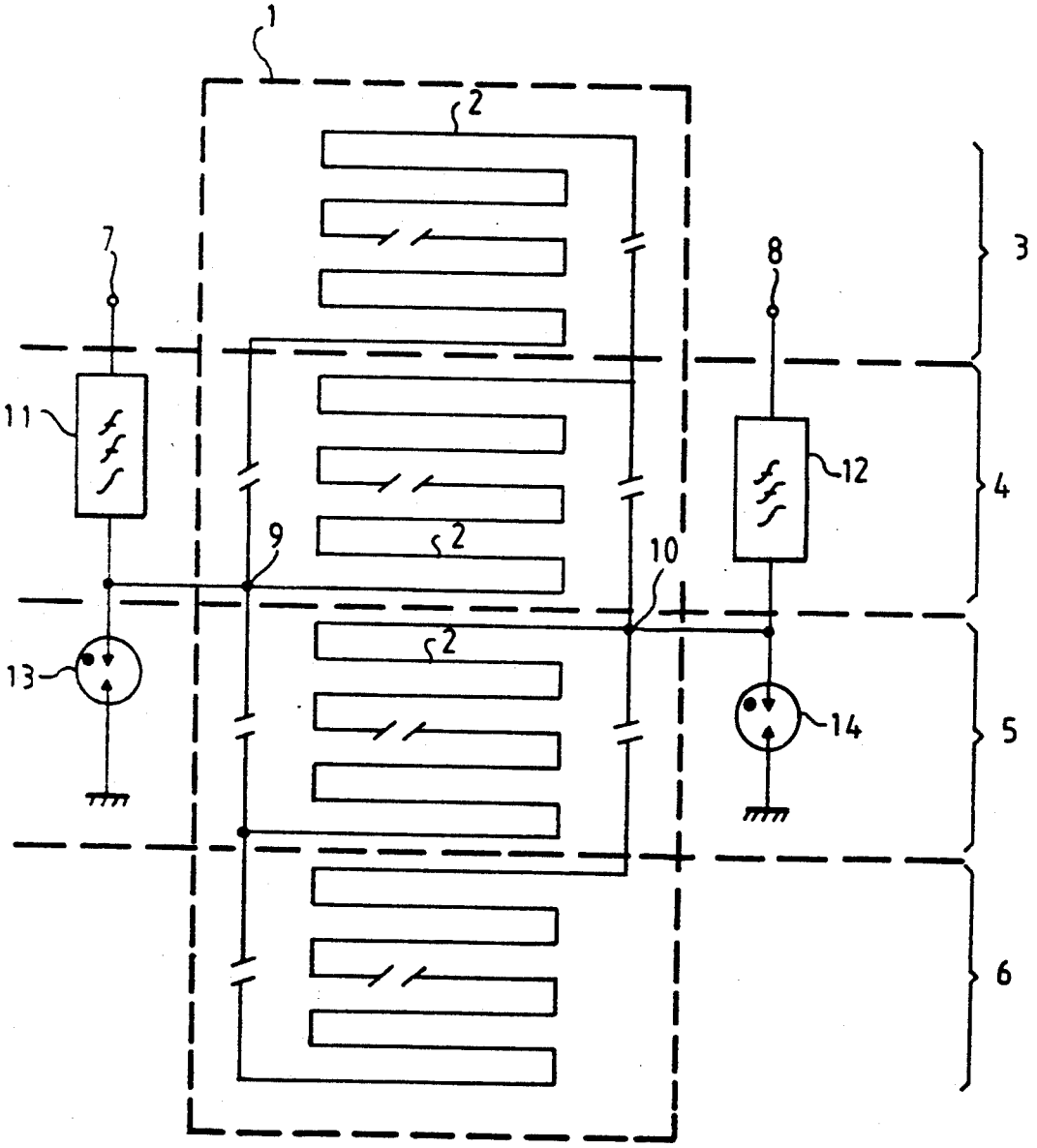
FIG. 1 PRIOR ART
FIG. 1 shows a prior art anti-icer system.

FIG. 1 shows a screen that gets positioned before the aperture of an electronic scanning radar antenna. This screen is made of epoxy silica. It is covered with a vertical polarization grid formed by a fine network of horizontal rectilinear conductive wires 2 which have also been used to form a heating grid constituting an anti-icer system.

In this heating grid, the horizontal rectilinear conductive wires 2 are connected to one another by their ends in series-parallel combinations that form zigzag patterns 3, 4, 5, 6 distributed on the height of the screen 1 and enabling them to be connected at 9, 10 to conductors connected to terminals 7, 8 designed for the connection of a supply source giving a heating current.

In a known way, the zigzag patterns 3, 4, 5, 6 are identical. They form turns, connected in parallel to the terminals of the supply source, wherein an electromagnetic pulse may induce electromotive forces that get added together. These induced electromotive forces are turned away from the supply source by means of pulse current blocking low-pass filters 11, 12 interposed in series before the connection terminals 7, 8 and directed towards the ground by means of dischargers 13, 14 connected between the ground and the head 9, 10 of the low-pass filters 11, 12.

With this distribution, in identical patterns, of the horizontal rectilinear conductive wires 2 of the polarization grid within the anti-icer system, the low-pass filters 11, 12 and the dischargers 13, 14 should be sized so as to be able to bear the energy induced by a nuclear electromagnetic pulse in an equivalent turn having an area practically equal to half that of the screen. As a consequence, they are fairly bulky, heavy and costly.

Figure 2:
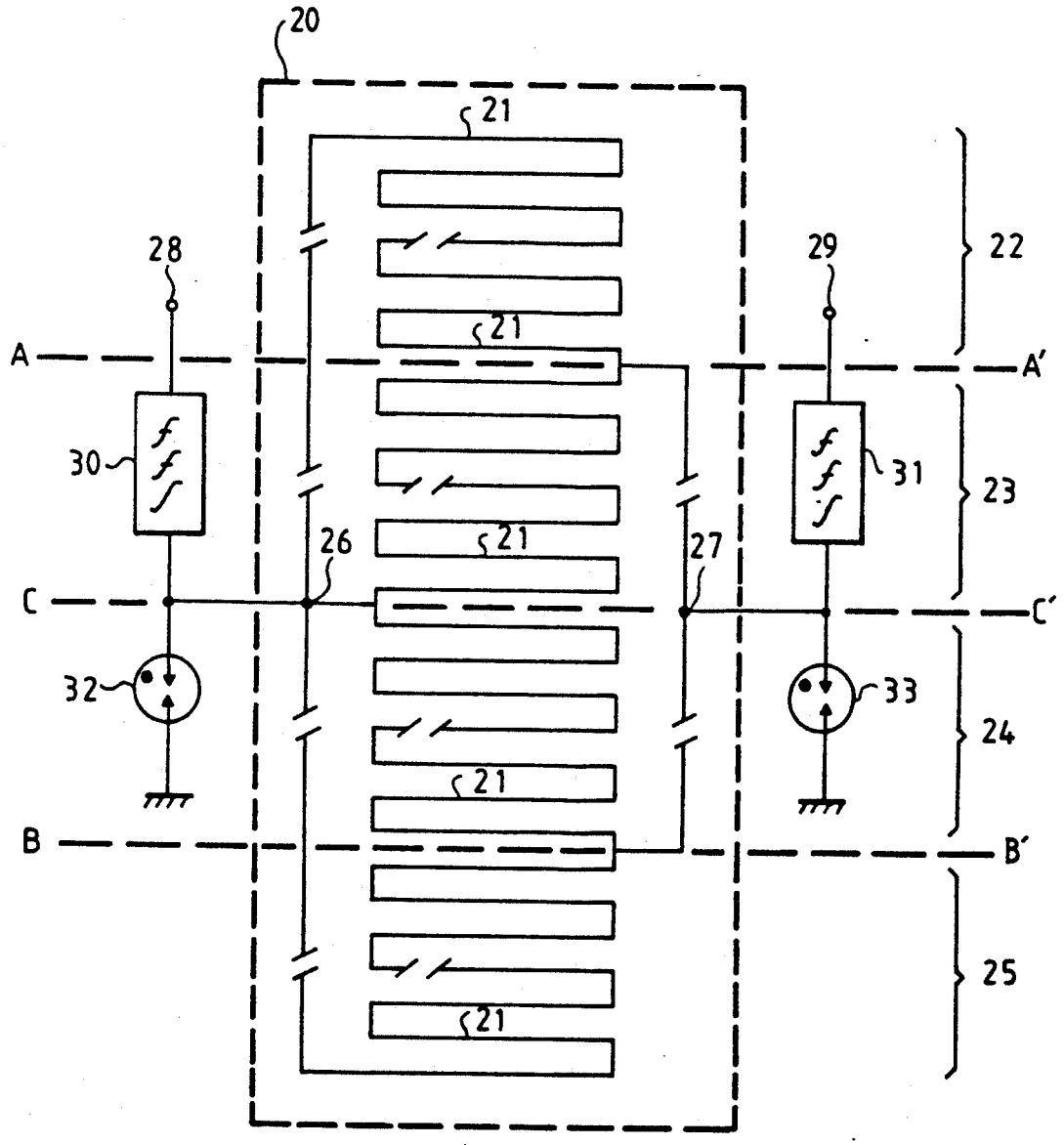
FIG. 2 shows an anti-icer system according to the invention.

To limit the energy induced by a nuclear electromagnetic pulse at the terminals of the supply source giving the heating current of the anti-icer system it is proposed, in accordance with FIG. 2, to constitute, with the horizontal rectilinear conductive wires of the vertical polarization grid and their series-parallel connection, patterns that are symmetrical in pairs with respect to an axis. Through this symmetry, the electromotive forces induced in the turns constituted by two patterns of one and the same pair neutralize each other. The area of the turn equivalent to the de-icing system is thus reduced at least by a factor of 10. This affects the sizing of the dischargers and the low-pass filters, the volumes, weights and costs of which diminish accordingly.

This FIG. 2 shows a screen 20 which, like the previous one, gets placed before the aperture of an electronic scanning radar antenna. This screen 20 is also made of epoxy silica and is covered with a vertical polarization grid formed by a fine network of horizontal rectilinear conductive wires 21 used to make the heating grid of an anti-icer system.

To make this heating grid, the horizontal rectilinear conductive wires 21 of the vertical polarization grid are connected to one another, by their ends, in series-parallel combinations that form two pairs of symmetrical zigzag patterns 22, 23 and 24, 25 distributed over the height of the screen and enabling them to be connected at 26, 27 to conductors leading to terminals 28, 29 designed for the connection of a supply source giving a heating current. As above, these connection points 26, 27 are connected, firstly, to the connection terminals 27, 28 of the supply source by means of two pulse current blocking low-pass filters 30, 31 and, secondly, to the ground by means of two dischargers 32, 33.

The zigzag patterns 22, 23 of the first pair which cover the top of the screen 20 are symmetrical in relation to a horizontal axis AA'. Owing to this symmetry, they constitute turns having the same area crossed by induced electromotive forces of a same amplitude that flow in opposite directions and get combined in opposition at the connection points 26, 27 where they neutralize each other. The zigzag patterns 24, 25 of the second pair, which cover the bottom of the screen 20 are symmetrical with respect to a horizontal axis BB'. Owing to this symmetry, they further constitute turns having the same area crossed by induced electromotive forces of a same amplitude that flow in opposite directions and get combined in opposition to the connection points 26, 27 where they neutralize each other.

The two pairs of zigzag patterns 22, 23 and 24, 25 are furthermore symmetrical with each other in relation to a median horizontal axis CC'.

In practice, each horizontal rectilinear conductive wire drawn as a single element in the figures is formed by the parallel arrangement of several, for example four, horizontal rectilinear conductive wires neighboring the polarization grid, thus ensuring the continuity of the anti-icer grid, even when there is a break in one of the horizontal rectilinear conductive wires.

What is claimed is:

1. An anti-icer system for a radar antenna comprising a sheet of conductive wires positioned on a screen placed before an aperture of the radar antenna, said sheet of conductive wires having at least one pair of patterns, each pattern formed by horizontal elements connected in series in a zigzag manner, the patterns being connected in parallel to the terminals of a supply source so that each is crossed by a heating current, said at least one pair of patterns being each symmetrical with reference to a corresponding one of at least one first axis.

2. A system according to claim 1, wherein said conductive wires and their interconnections form zigzag patterns on the screen.

3. A system according to claim 1, wherein said at least one pair of patterns comprises two pairs of patterns on the screen, the patterns of each pair being symmetrical with each other in relation to said corresponding one of at least one first axis.

4. A system according to claim 3, wherein the two pairs of patterns are symmetrical with each other in relation to a second axis.

5. A radar antenna grid, comprising:

a sheet of wires placed before an aperture of the antenna, the sheet comprising patterns, each pattern comprising:

horizontal elements connected in series in a horizontal zigzag pattern;

a top output terminal means connected to an end of a top horizontal element;

a bottom output terminal means connected to a bottom horizontal element;

the radar antenna grid further comprising:

two terminal connectors connected to the top and bottom output terminal means such that a number of top terminal means and a number of bottom terminal means connected to one of the two terminal connectors are equal, and a number of top terminal means and a number of bottom terminal means connected to the other of the two terminal connectors are equal.

6. A radar antenna grid according to claim 5, further comprising:

de-icing means connected to each terminal connector for transmitting a heating current through the horizontal elements.

* * * * *